US006376737B1

(12) United States Patent
Saito et al.

(10) Patent No.: US 6,376,737 B1
(45) Date of Patent: Apr. 23, 2002

(54) PROCESS FOR DECOMPOSING CHLOROFLUOROCARBON AND SYSTEM FOR DECOMPOSITION THEREOF

(75) Inventors: Yoshihisa Saito; Takehiko Moriya, both of Sendai; Masazumi Kanazawa, Kochi, all of (JP)

(73) Assignees: Ohei Developmental Industries Co., Inc., Kochi (JP); Tohoku Electric Power Co., Inc.

( * ) Notice: Subject to any disclaimer, the term of this patent is extended or adjusted under 35 U.S.C. 154(b) by 0 days.

(21) Appl. No.: 08/863,472

(22) Filed: May 27, 1997

(30) Foreign Application Priority Data

May 27, 1996 (JP) ..... 8-155993

(51) Int. Cl.[7] ..... A62D 3/00
(52) U.S. Cl. ..... 588/208; 588/209; 588/213
(58) Field of Search ..... 588/208, 209, 588/213

(56) References Cited

U.S. PATENT DOCUMENTS 4,555,361 A * 11/1985 Buckley et al. ..... 588/209
5,188,041 A * 2/1993 Noland et al. ..... 588/209
5,200,033 A * 4/1993 Weitzman ..... 159/47.1
5,416,247 A * 5/1995 Webster ..... 588/206
5,498,827 A * 3/1996 Khan et al. ..... 588/213
5,550,311 A * 8/1996 Young ..... 588/213
5,582,800 A * 12/1996 Galloway ..... 588/247
5,710,359 A * 1/1998 Lercher et al ..... 588/213
5,710,360 A * 1/1998 Self et al. ..... 588/209

FOREIGN PATENT DOCUMENTS

DE 3900268 * 8/1989 ..... 588/208
JP 5856396 12/1983
JP 2-303586 * 12/1990 ..... 588/213
JP 312220 1/1991
JP 2612249 9/1997

* cited by examiner

*Primary Examiner*—Steven Bos

(57) ABSTRACT

A method is provided for decomposition of chlorofluorocarbon to be decomposed and then disposed of. The process includes the following the steps of. A mixture of liquid chlorofluorocarbon substances to be decomposed (and then disposed of) and a liquid member are heated to a temperature of from about 500° C. to about 700° C. in order to produce a superheated vapor. The liquids member may be water, methanol, hydrogen peroxide, or mixtures thereof. The superheated vapor is maintained in a reactor for a sufficient reacting time in order to achieve decomposition of the chlorofluorocarbon in the mixture before passing through the reactor to a discharge outlet open to the environment.

3 Claims, 14 Drawing Sheets

PROCESS FOR DECOMPOSING CHLOROFLUOROCARBON AND SYSTEM FOR DECOMPOSITION THEREOF

BACKGROUND OF THE INVENTION

1. Field of the Invention

This invention relates to a process for decomposing persistent substances, including environmental contaminants, more particularly a processing system for dissolving chlorofluorocarbon gas, plastics, such as polystyrene, wood, organic compounds which have a benzene nucleus, and other persistent substances of industrial wastes, in a superheated steam atmosphere by using thermal cracking, hydrolysis, reduction, oxidation, and combinations thereof.

2. Background of the Invention

Chlorofluorocarbon gas used as a refrigerant, and halogen gas used as an extinguishing agent are indicated to be environmental contaminants, so that a process for converting these substances into harmless substances has now became a world-wide concern in regards to preserving the global environment. Thus, several means to solve these problems have already been proposed. For example, a process for decomposing chlorofluorocarbon (trichlorofluoromethane, etc.) has been proposed, which uses such processes as, hydrothermal reaction, burning, cracking by explosive reaction, biochemical decomposition, ultrasonic dissolving and plasma reaction.

Among these processes, the hydrothermal reaction is considered to be a general purpose processing system which is applicable to any substances to be decomposed, including mainly, waste such as organic solvents like Trichlene (trichloro ethylene), waste oil, dioxin, PCB, feces etc. It can decompose, for example, chlorofluorocarbon gas into safe substances, such as sodium chloride and carbon dioxide.

To implement a device which uses hydrothermal reaction, experiments using an autoclave have been conducted, for example, in laboratories under conditions of mixing ratios for caustic soda, ethanol, and chlorofluorocarbon; and time settings for temperatures; pressure reaction times setting, and the reaction is conducted under the condition that it is kept at a high temperature of 300–450 (° C.) with the high pressure of 100–250 kg/cm$^2$.

The application of the present invention has proposed the process and device for decomposing environmental contaminants by using the hydrothermal reaction process mentioned above in Japanese patent Application Heisei-6-2045 19. The content of the Application will be briefly reviewed here, referring to the flowchart of the chlorofluorocarbon decomposition process shown in FIG. 13, wherein the tank 1 for storing liquid mixtures of chlorofluorocarbon liquid, caustic soda, and ethanol, and the liquid is send by the pump 2 via the flow meter 3 and the piping 3 to the heat exchanger 5. It is in turn sent to the hydrothermal reactor 6 in which hydrothermal reaction occurs, before being returned to reactor 5 and further sent via the cooler 7, the pressure regulating valve 8 to the separator 9 which separates the liquid into the pure water and substances. The tank 1*a*, the pump 2*a* and the flow meter 3*a* shown in FIG. 13 comprise a system which is used if the chlorofluorocarbon belongs to the type which is gasified at a normal temperature.

Each of the pumps 2 and 2*a* use a normal slurry pump. It requires a high force feed pressure produced by a vacuum of suctioning, and a good volume efficiency, and uses a force feed cylinder for high density slurry, pulverulent body mixed slurry, and acid or alkali slurry.

The reactor 6 has such an arrangement that the liquid mixture flowing via the heat exchanger 5 is led into the inlet 11, and it then flows through the piping 12 around which the band heater 13 is wound to exit from the outlet 14 as shown in FIG. 14. The band heater 13 has a suitable number of heaters, which are disposed along the piping 12, keeping each other within a suitable distance, and being controlled to have a constant temperature inside of it. Further, the cooler 7 has normal cooling equipment formed around the reactor tube to provide a pass way for the cooling water.

Heat decomposing equipment is disclosed in the Japanese Patent Laid-Laid-open Publication No. 58-56396, wherein superheated steam, which is generated by a superheated steam generator, is ejected into a decomposing furnace to separate or decompose waste tires into residue, such as decomposed gas and carbon dust, and tire bead for reuse. Also, in the Japanese Patent Application TOKKAIHEI 3-12220 a hydrolysis process is disclosed, wherein sodium fluoride alkane (Freon) is put in contact with a catalyst, made of activated carbon, carrying ferrous oxide in the presence of steam to convert it into harmless compounds.

As indicated above, the hydrothermal reactor 6 is required to be operable at a high temperature with a high pressure, so that it correspondingly makes the pressure regulating valve 8 have a complicated structure, resulting in a high price, and there is difficulty in designing its structure to have sufficient mechanical strength against such pressures as tensile stress, and thermal stress. A mechanism which is required to operate at a high temperature with a high pressure, has problems because it becomes complicated in its structure; has to be changed in order to meet with the type of decomposing substances, and is difficult to control in operation. In response to the high pressure, the piping 4 often fractures during operation, so that difficulty remains from the point of view of safety.

The hydrothermal reaction process mentioned above comprises a closed system, but such methods as rotary kiln process or incineration process are required to provide some measures against dioxin that is produced during the processing. It is also difficult for other processes to change the reacting process in order to meet the substances that are to be decomposed, and has some defect that it requires high running and initial costs since it requires a dedicated equipment, therefor it has little generality.

The thermal decomposing equipment disclosed in aforementioned Japanese Patent Laid-open Publication No. 58-56396 can decompose waste tire into wastes such as cracked gas carbon and carbon. It does not refer to any effective decomposition of persistent substances, such as chlorofluorocarbon which are subjective substances of the present invention, and cannot be practised to decompose the persistent substances. Also, the process as disclosed in the Japanese Patent Laid-open Publication No. 3-12220, in which chlorofluorocarbon is put in contact with the catalyst in the presence of steam to decompose it hydrolytically, could not apply to decomposing processes of other industrial wastes except chlorofluorocarbon, for example organic compounds which have a benzene nucleus, and it could not expect sufficient effects in decomposing efficiency according to the type of chlorofluorocarbon, and furthermore has little durability with the catalyst used for this. It is thus clear to have a problem, that it is not applicable for decomposing mixtures of chlorofluorocarbon and oily substances.

SUMMARY OF THE INVENTION

An objective of the present invention, is to provide a system for decomposing environmental contaminants such as chlorofluorocarbon gas, plastics such as polyethylene, woods, organic compounds, which may have benzene nucleus, and other industrial wastes of persistent substances. This system is able to decompose these contaminants under atmospheric pressure or without requiring them to be put under high pressure.

A further objective of the present invention, is to provide a process and a system for decomposing persistent substances, which allows suitably to select substances for constructing it, and to increase decomposition efficiency, or to decompose more easily the mixture of solid components and liquid persistent substances.

To attain these objectives, a process, according to the present invention, characterized by heating a mixture of decomposed substances to be disposed of and a solvent to a predetermined heating temperature, to produce a superheated vapor, and maintaining this superheated vapor for a predetermined reacting time, within a reactor, before passing through this reactor, inside of said reactor being heated at a predetermined temperature under the atmospheric pressure.

Also, the process, according to the present invention, is characterized by heating a mixture of said substances and a solvent to produce a vapor, which is further heating mixture of these substances and a solvent to produce a vapor, which is a further heated up to a predetermined temperature to produce the superheated vapor, and maintaining said superheated vapor for a predetermined reacting time within a reactor before passing through said reactor, inside of said reactor being heated at a predetermined temperature, under the atmospheric pressure.

Further, the process according to the present invention, is characterized by heating a solvent to produce a vapor, which is further heated up to a predetermined temperature to produce a superheated solvent vapor, which will be continuously supplied into a reactor, heated at a predetermined temperature under the atmospheric pressure, supplying said substances into the inside of said reactor, said inside having an atmosphere of said superheated solvent vapor, and maintaining for a predetermined reacting time before passing through said reactor.

Further, the process according to the present invention, is characterized by the fact that the substances to be decomposed, which includes solid matter, are arranged to be maintained for the predetermined reaction time within the reactor before passing through said reactor for discomposing said substances and solid components remaining in the reactor are dropped into a discharging pipe to store in the waste tank.

Still further, the process according to the present invention, is characterized by the fact that the substances to be decomposed, which includes solid matter, are stirred and heated for a predetermined reaction time within said reactor.

Still further, the process, according to the present invention, is characterized by supplying said superheated vapor decomposed with a new solvent into said second reactor.

Still further, the process, according to the present invention, is characterized by cooling said superheated steam, which completes the decomposing process, to liquefy and discharge.

Still further, the process, according to the present invention, is characterized by the fact that the solvent is one or more than one selected from water, methanol, caustic soda, and hydrogen peroxide.

Still further, the process, according to the present invention, is characterized by the fact that the temperature of the superheated vapor is 500° C.–750° C. when the substances to be decomposed is chlorofluorocarbon.

A further objective of the present invention is to provide a decomposition system for persistent substances, which may comprise a superheated vapor generator means for superheating a mixture of substances to be decomposed and a solvent, to a predetermined temperature to produce a superheated vapor, and an atmospheric pressure reactor means for maintaining said superheated mixture inside thereof to decompose for a predetermined reaction time, inside of said atmospheric pressure reactor means being maintained at a predetermined temperature under atmospheric pressure.

Further, the decomposition system may comprise a vapor generator means for heating a mixture of substances to be decomposed and a solvent to generate a superheated vapor for heating said vapor further to a predetermined temperature to provide a superheated vapor, and an atmospheric pressure reactor means, inside of which is maintained at a predetermined temperature under atmospheric pressure, for maintaining said superheated vapor within thereof for a predetermined reaction time to decompose.

Further, the decomposition system may comprise a vapor generator means for heating a solvent (to generate a solvent vapor), a superheated vapor generator for heating said solvent vapor further to a predetermined temperature to provide superheated solvent vapor, and an atmospheric pressure reactor means for receiving and maintaining said superheated solvent vapor and said substances to be decomposed inside thereof to decompose for a predetermined reaction time, inside of said atmospheric pressure reactor being maintained at a predetermined temperature.

Further, the decomposition system may comprise means which have a transporting means for transporting said substances to be decomposed after said substances elapsed for a predetermined time, said substances including solid components, a discharging pipe for discharging solid components from the reactor, by dropping therefrom, said solid component remained inside the reactor, and a waste tank for storing said dropped solid components inside thereof.

According to the decomposing process of the present invention, organic compounds, which include chlorofluorocarbon gas and benzene nucleus and other persistent substances including environment contaminants, are converted to vapor as well as solvents, which are further heated up from superheated vapor under atmospheric pressure with only its temperature raised, or further it supplied into a superheated solvent vapor atmosphere for maintaining a predetermined reaction time in passing through the reactor thus to become decomposed substances. The superheated vapor which results from the decomposing process is then cooled to liquefy and to discharge. In case of persistent substances including solid components, it is decomposed during passing through the inside of the reactor by a transporting device and remaining solid components are discharged from the reactor. Decomposition may be promoted within the reactor by performing a stiffing process on the substances to be decomposed.

DETAILED DESCRIPTION OF THE INVENTION

Figure 1:
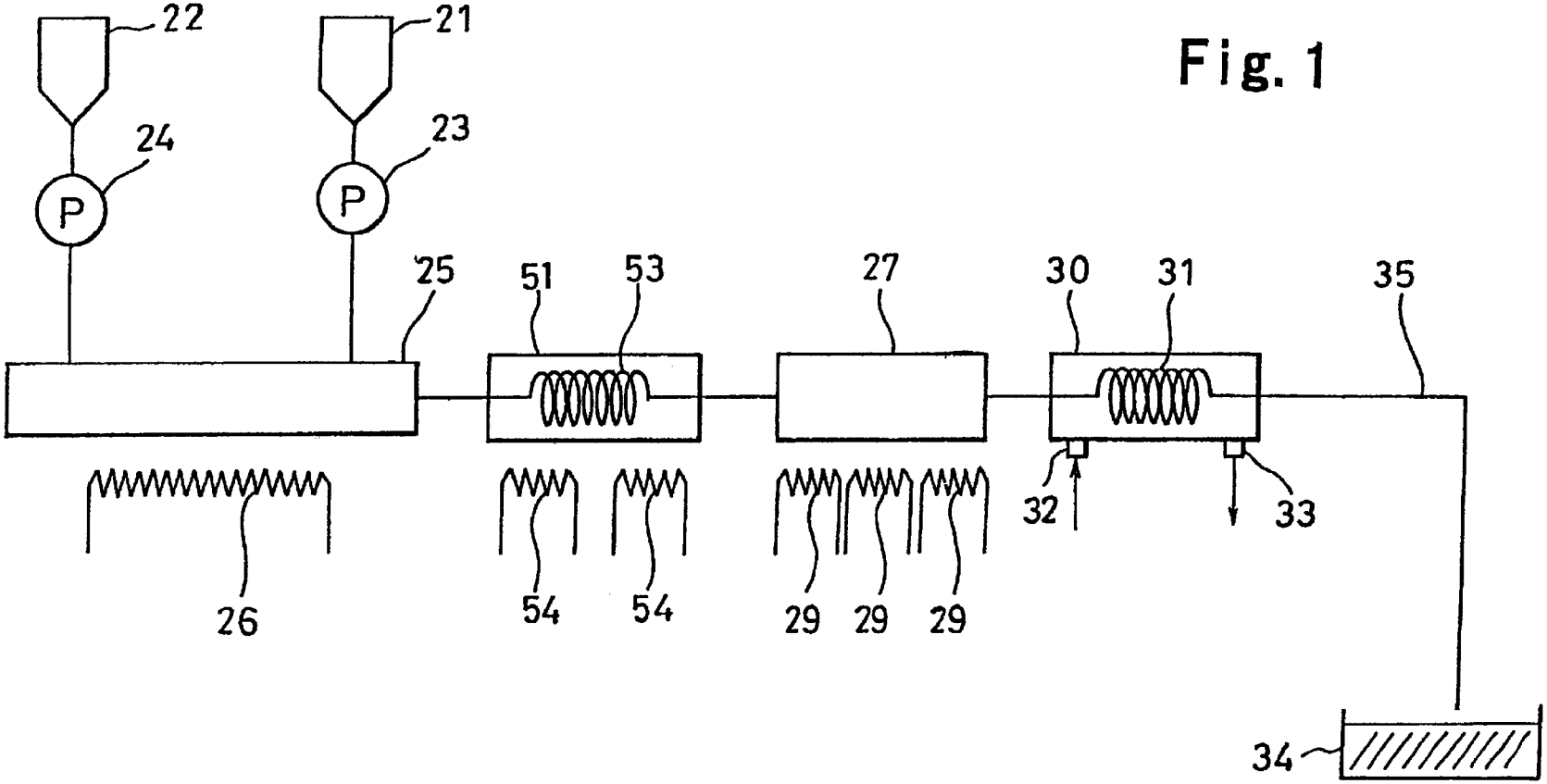
FIG. 1 is a schematic diagram of a system, according to the first embodiment of the present invention.

A detailed description is now presented of the decomposing process and equipment for dissolving persistent substances, according to a preferred embodiment of the present invention. In view of the problems in the hydrothermal reaction process of the prior art described above, as a result of several experiments to improve the process by the inventor, it is known that substances to be decomposed in superheated steam can be decomposed by using hydrolysis, reduction, oxidation, and combinations thereof, when the substances to be decomposed, as a persistent substance such as chlorofluorocarbon, are converted into superheated steam using a solvent, such as water, methanol, hydrogen peroxide, and which keeps its state during a predetermined reaction time, so that a discharging outlet of the reactor is allowed to be opened for the normal pressure. That is, without requiring any high pressure state inside of the reactor, only its temperature is kept high, to maintain the atmosphere of the superheated steam. Now, in order to realize the objective of the present invention based on the facts described above, the preferred embodiment will be described.

In this embodiment, the persistent substances, including (among others) environmental contaminants such as chlorofluorocarbon, are to be decomposed under the influence of atmospheric pressure. The term persistent substances refers to stable organic compounds, which may include any substances without any specific limitations, including industrial wastes such as chlorofluorocarbon gas, organic compounds such as trichloethylene, waste oil, dioxin, PCB, excrements, woods, paper, rubber. It should be noted that the substances include mainly 1) organic compounds which are useful but difficult in managing after use, which are harmful, such as chlorobenzene, chlorofluorocarbon (hydrocarbon halides), dioxin which is currently problematic, PCB which is not used today, and 2) organic compounds which are useful and very stable, but are difficult to treat, although they are not harmful, such as PE, plastics, rubber. It should be noted that these substances are mostly made from petroleum substances, and can be converted or decomposed, into oil or fuel such that these can be used or recycled. Furthermore, for rubber, more specifically its organic substances, the aim is to convert or decompose it into a harmless or recyclable substance (s). Decomposing for papers and woods is to decompose or convert cellulose components of these into glucose, that is, it is to convert less valuable substances into more valuable ones.

The solvent used in the embodiment of the present invention may be selected from any of the substances that can be converted into vapor by heating it, and the most preferable one is water. More specifically, chlorofluorocarbon gas is sufficiently decomposable when used with methanol as a solvent. Caustic soda and hydrogen peroxide are also useable as solvents, respectively. Oxygen percentage can also be increased, which result in wet oxidation employable in decomposing. According to the preferred embodiment of the present invention, the benzene ring can be opened, and benzene, which is the main objective substance to be decomposed, which is a fundamental compound of hydrocarbon of an aromatic group which is represented as $C_6H_6$, and monochlorobenzene is expressed as $C_6H_5Cl$. Phenols can be indicated, which contain organic compounds with a benzene nucleus. The phenols are general terms for organic compounds, each of which have a benzene nucleus linked with OH radical and expressed as $C_6H_5OH$.

The first preferred embodiment of the present invention is shown in FIG. 1 wherein reference number 21 denotes a liquid storage tank in which liquid components are stored, 22 denotes a solvent tank, 23 and 24 denote fluid pumps, 25 denotes a vapor generator in which a heater 26 is provided. 51 denotes a superheated vapor generator which additionally superheats the vapor generated in the generator 25 to raise only the temperature itself and thus provides superheated vapor, and inside of which a pipe 53 from the generator 25 is formed in the shape of a spiral. 27 denotes a reactor in which substances to be decomposed and the superheated vapor are kept at a predetermined temperature, and are considered to take a predetermined time period when they are passing through it, in order to decompose them. To accomplish this, the reactor 27 may take any arrangement unless the superheated vapor takes the predetermined time in passing though it, and thus it does not necessarily require the piping to be laid in the spiral form. The reactor may also be arranged to pass through the superheated vapor, in a suitable shape other than the spiral form in order to take reaction. Reference numbers 29 denote heaters which are placed respectively along the reactor in order to maintain it at the predetermined temperature.

A discharge outlet (not shown) of reactor 27 is open to the normal environment so that any pressure is applied to the inside of it, that is the reactor 27 is held under atmospheric pressure. This means that the pressure at the inlet side of the piping is determined only by a pressure gradient produced by pressure loss in the piping. The present invention is characterized in that an open type of arrangement is used for the reactor 27, which is able to decompose persistent substances, although it does not forcibly apply any pressure to the reactor. This is different from the high pressure hydrothermal reactor of the prior art. However, inside of the reactor a small degree of pressure difference is inherently produced due to the superheated vapor which causes it to generate a pressure gradient for transferring the substances to be decomposed. According to the present invention, the term atmospheric pressure means that the outlet is being opened without forcing any high pressure as is required in a conventional hydrothermal reactor.

Reference number 30 denotes a cooling unit in which a piping 31 in the shape of spiral form is placed, which communicates with the piping from the reactor 27. 32 denotes an inlet of cooled water, and 33 denotes the outlet for the water. 34 denotes a discharging liquid tank, into which the other end of the piping 35 from the cooling unit 30 feeds.

Now the operation of the first preferred embodiment will be explained, wherein chlorofluorocarbon gas is described as an example of the environmental contaminants of persistent substances to be decomposed. Chlorofluorocarbon as a substance to be decomposed is stored in the liquid storing tank 21, and a solvent, such as water and methanol, is stored in the solvent tank 22. The fluid pumps 23 and 24 are started in order to send both the chlorofluorocarbon and the solvent into the vapor generator 25 via the communicating piping, in order to mix both in a predetermined ratio.

The heater 26 provided inside of the vapor generator 25 is operated to heat it initially at 200–300° C., so that both the chlorofluorocarbon and the solvent are evaporated to produce a vapor mixture within the vapor generator 25. The generator 25 is used as a preliminary heater for producing the vapor mixture, so that it can be any type that can hold at least the temperature to produce the vapor. The specific volume is increased when the vapor mixture is generated, resulting in some pressure $kg/cm^2$ being produced, with which the vapor mixture is transferred via the spiral piping 53 placed within the superheated vapor generator 51 of the next stage.

The superheated vapor generator 51 operates the heaters 54 to heat the inside thereof to a predetermined temperature required to generate the superheated vapor, which is necessary for the decomposition process. The temperature of the superheated steam required in the decomposition process is determined in accordance with the substances to be decomposed, since the temperatures are different independently from substances. For example, the temperature of the superheated vapor is preferably more than 500° C. for chlorofluorocarbon gas, and approximately 400° C. for polyethylene. It should be noted that the temperature of the superheated vapor may also be allowed for more than that just described above. Thus, it is desirable to be superheated inside of the superheated generator 51 at the desired temperature of superheated vapor plus or minus 20° C. The superheated vapor, heated at approximately 300° C. may also allow, depending on substances to be decomposed, that is the temperature correspondingly set in regard to the respective substances to be decomposed and there is no limitation as to the temperature setting, unless it can ensure the superheated vapor to be generated. In case the substance to be decomposed is chlorofluorocarbon gas, the mixed vapor transferred by the pressure gradient from the vapor generator is thus superheated to approximately 500° C. and transferred to the reactor similarly; as described above.

The reactor 27 is arranged to maintain the temperature of the superheated vapor, by activating the preliminary heater 29. The reactor 27 is thus desirable to be superheated substantially, similar to that of the superheated vapor generator 51. A predetermined time period is required to decompose the substances included in the superheated vapor before the superheated vapor passes through the reactor 27 and the vapor is transferred to the cooling unit 30, of the next stage.

In cooling unit 30, the cooling water is supplied through cooling water inlet 32, which is in turn discharged from the outlet 33 to liquefy the gas, which is the substance to be decomposed, within the piping 31 in the shape of spiral form communicating with the reactor 27. The temperature within the cooling unit can be any temperature sufficient to liquefy the gas of the substances to be decomposed. For chlorofluorocarbon gas, the temperature is set to approximately 18° C. Liquefying the gas in this manner will prevent it from generating by-products, and also prevent it from releasing the gas itself into the air which may cause secondary pollution problems by directly spreading the gas into the air. The waste liquid is transferred via the piping 35 into the waste liquid tank 34 where it is stored. It may also equipped with a thermal exchanger within the cooling unit, through which thermal energy is collected which can be recycled for generating superheated steam.

Figure 2:
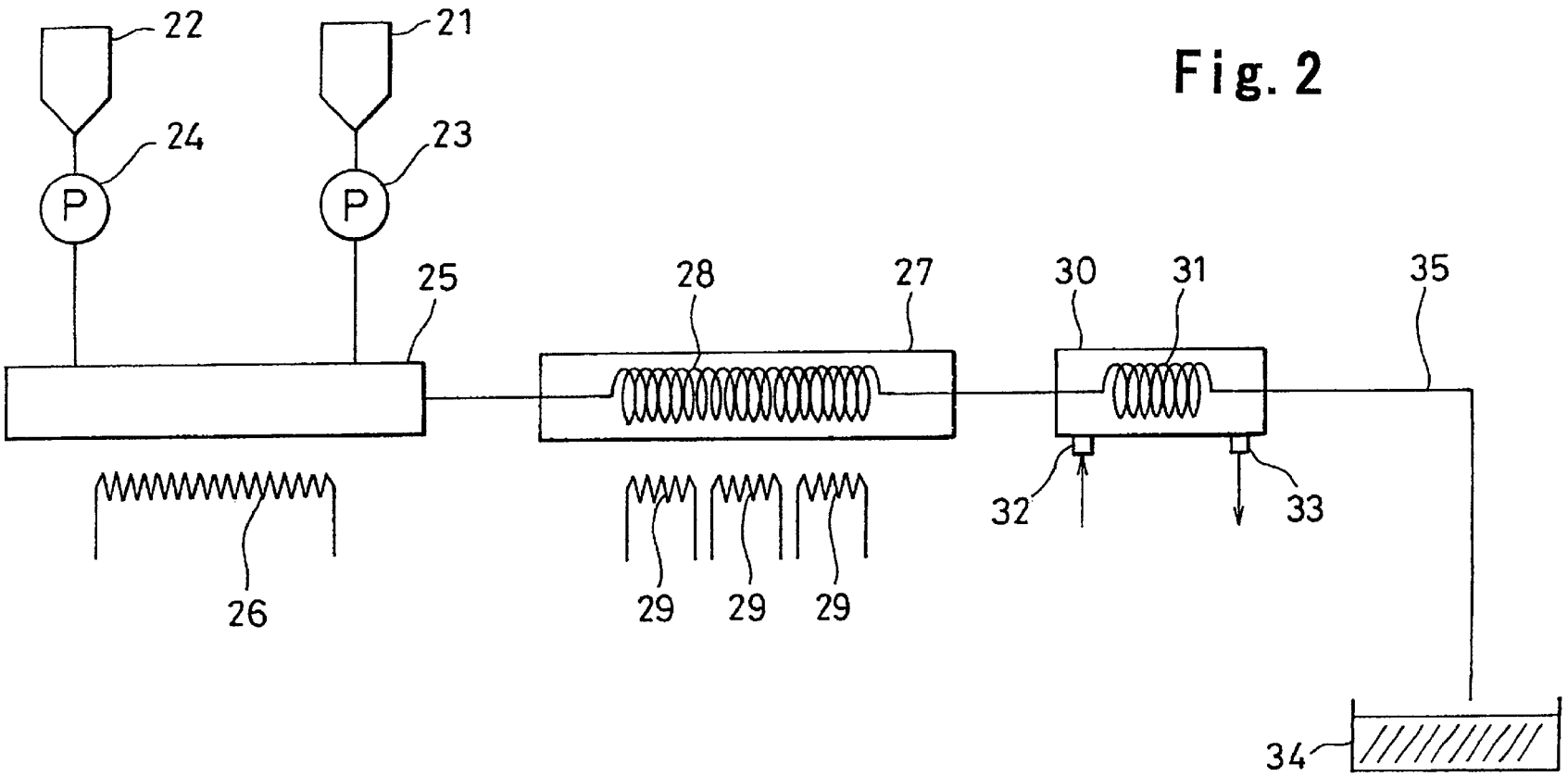
FIG. 2 is a schematic diagram of a system, according to a second embodiment of the present invention.

A second embodiment of the invention is shown in FIG. 2 wherein reactor 27 is an integral unit of the superheated vapor generator 1 and the reactor 27 shown in FIG. 1, and wherein similar components designate corresponding parts as that of the first embodiment shown in FIG, 1 respectively. In the arrangement shown in FIG. 2, a vapor mixture of more than 100° C. generated in generator 25 is transferred to reactor 27 operating as a superheated vapor generator, in which it is further heated to 500° C. to therefor a superheated state and kept at that state for a predetermined reaction time to decompose the substances to be decomposed.

In the arrangements of the embodiments shown in FIGS. 1 and 2, only the solvent is supplied as superheated vapor by the vapor generator 25 and the superheated vapor generator 27, and the substances are supplied into the atmosphere of superheated solvent steam within the reactor 27 wherein the substances are maintained for the predetermined reaction time. Further, several solvents such as chlorofluorocarbon, water and methanol may be mixed together as a treated process liquid to be directly supplied to the superheated vapor generator 51 shown in FIG. 1 or the reactor 27 which also operates as the superheated vapor generator 27 shown in FIG. 2.

An experiment has been performed for three different mixed gases:

1) methanol (solvent)+chlorofluorocarbon gas (substances to be decomposed).
2) chlorofluorocarbon gas (substances to be decomposed)+water (solvent).
3) chlorofluorocarbon gas (substances to be decomposed)+water (solvent)+methanol (solvent).

In case of 1), following the reactions occur inside of the reactor 27:

$$2CH_3OH+CCl_2F_2 \rightarrow 3C+2HF+2HCl+2H_2 \quad (1)$$

In case of 2), following hydrolysis reactions occur inside of the reactor 27:

$$CCl_2F_2+2H_2O \rightarrow CO_2+2HCl+2HF \quad (2)$$

In case of 3), the reactions of (1) and (2) occur simultaneously in a mixed manner.

It should be noted that adding a few percent of methanol to the water increases the decomposition rate by about 2–3 times.

In the case where water was used as the solvent of for chlorofluorocarbon, the mixed liquid changed to a strong acid due to the reaction of the hydrochloric and hydrofluoric acids produced by the reaction of the formula 2), which caused severe damage to the pipes of the equipment, and shortened the life of the equipment. Thus, usually an adequate mount of caustic soda, which is determined relative to the density of chlorofluorocarbon, is added to the liquid mixture to produce bicarbonate of soda from carbon dioxide, and sodium chloride from caustic soda and hydrochloric acid as expressed in the following formula 4). Sometimes a measurement is required for producing sodium flouride NaF resulting from the reaction between the caustic soda and hydrofluoric acid as shown in formula 5).

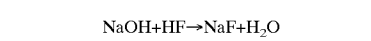

$$NaOH+CO_2 \rightarrow NaHCO_3 \quad (3)$$

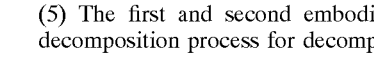

$$NaOH+HCl \rightarrow NaCl+H_2O \quad (4)$$

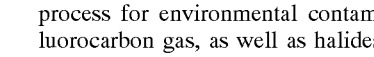

$$NaOH+HF \rightarrow NaF+H_2O \quad (5)$$

(5) The first and second embodiments are to provide a decomposition process for decomposing substances having liquid or gaseous form, and to provide a decomposable process for environmental contaminants, such as chlorofluorocarbon gas, as well as halides in liquid form, such as chlorobenzene, and Trichlene. As the experimental condition for chlorofluorocarbon gas, the operational temperature has been selected as 180° C. for an evaporator located inside of the vapor generator 25; to 500° C. for the inside of the reactor; and to 180° C. for the piping 31 inside of the cooler 30 respectively. Also, both water and methanol are selected as the solvents, to be excess in mole percent:

Methanol: chlorofluorocarbon gas=3:1 chlorofluorocarbon gas: water=1:3 chlorofluorocarbon gas: water: methanol=1:3:3

The decomposition ratio is then sufficiently decreased such that any chlorofluorocarbon is not detected by use of a gaschromatography , that is, decomposition ratio of more than 99.99% is attained.

Figure 3:
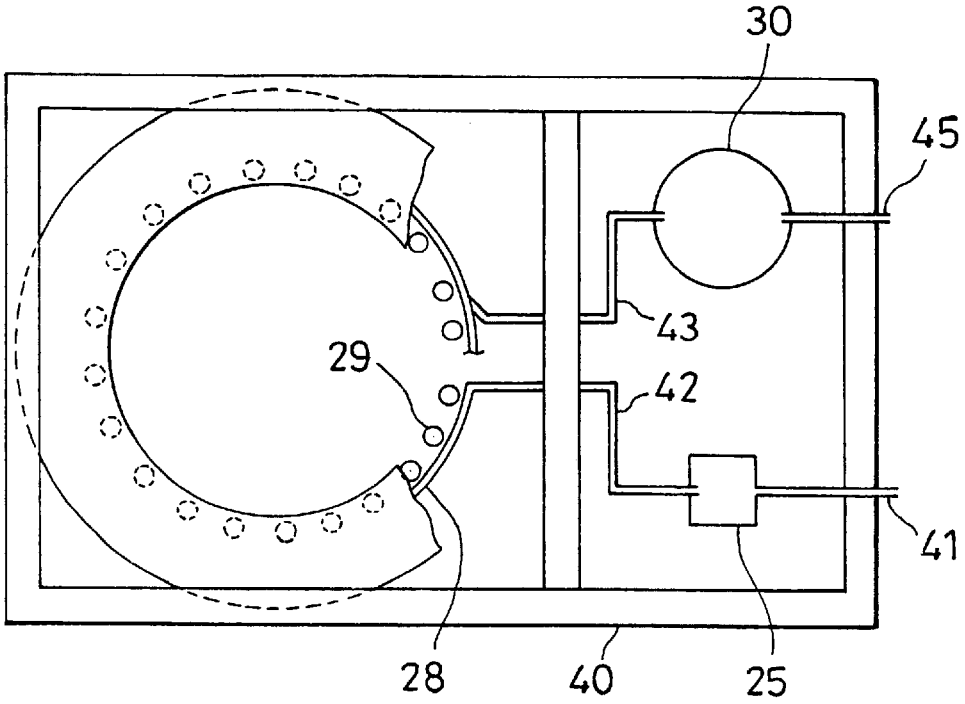
FIG. 3 is a plan view of the second embodiment with a detailed portion in cutaway view.
Figure 4:
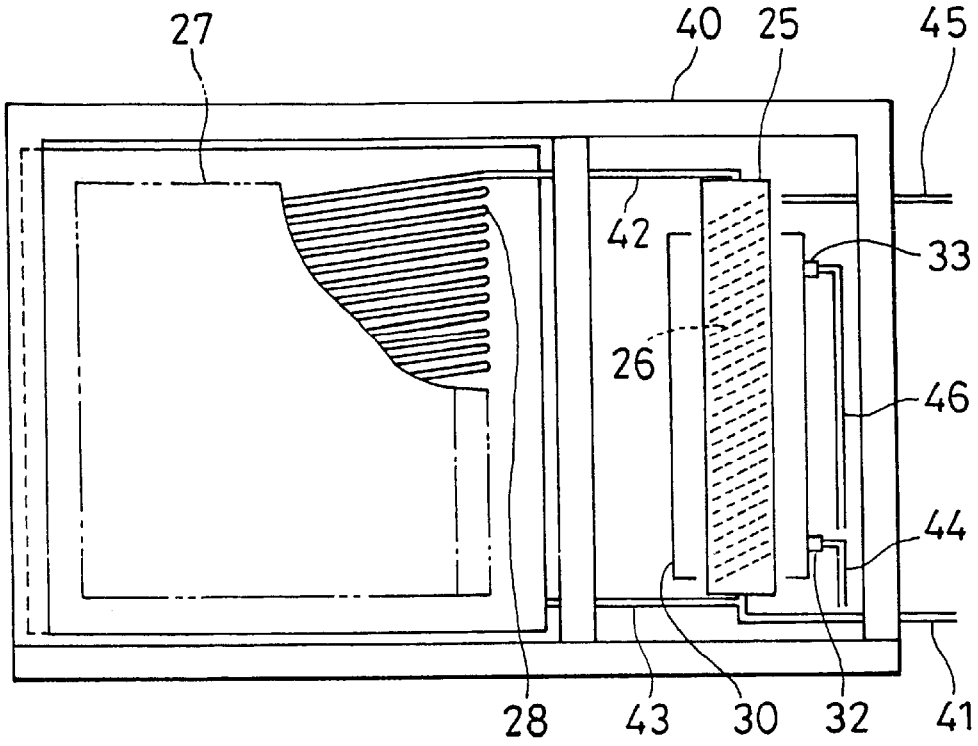
FIG. 4 is a front view of the second embodiment shown in FIG. 3.
Figure 5:
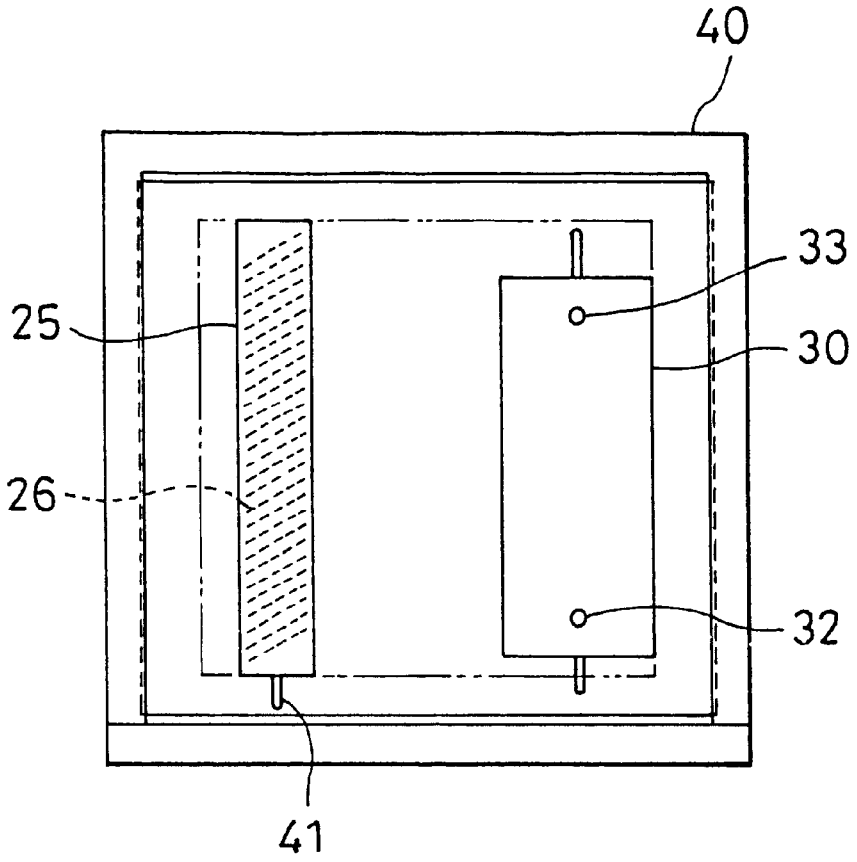
FIG. 5 is a side view of the second embodiment shown in FIG. 3 with a portion in cutaway view.

Detailed illustrations of the second embodiment of the invention shown in FIG. 2 are shown in FIG. 3–FIG. 5, wherein FIG. 3 is the detailed portion in plan view with portion shown in cutaway view, FIG. 4 is a front view, and FIG. 5 is a left side view with portion shown in cutaway view. Reference number 40 illustrates a chassis in which several components comprising the system are contained, 41 is an inlet which is provided at an end of the chassis 40 for introducing the substances to be decomposed, and 25 is a vapor generator in which the heater 26 is positioned. The other end of piping 42, which is led from an upper portion of the generator 25, is connected to piping in the shape of spiral form. Heaters 29 are provided in the periphery of the reactor 27.

A piping 43 is provided which extends through a lower portion of the reactor 27 to the next stage of the cooler 30, which has an inlet 32 for introducing cooled water, and an outlet 33 for discharging water, and the inlet 32 is in turn connected to a water piping 44 (see FIG. 4).

According to this arrangement, a mixture of the substances to be decomposed, and solvent(s), are introduced from inlet 41, which introduces liquid to be treated, and flows into bottom of (the) generator 25, and moves upward within it, while the mixture is heated to cause mixed gas to generate. The gas in turn flows into the piping comprising the reactor 27, which is also operating as a superheated vapor generator, from the top of the generator 25 via the piping 42. The gas is thus superheated by the heaters 29 and converted into a superheated vapor which maintains its state (at least) for a predetermined period of time which is sufficient to decompose the vapor according to the decomposition reactions shown by the formulas (1) and (2), while the vapor passes through the reactor 27, and the resulting substances flows into the bottom of cooler 30 via the piping 43 from the bottom of the reactor 27. The resulting substances are liquefied while flowing from the bottom of cooler 30 towards the top thereof due to cooling effect with the cooling water which flows from the inlet 32 to the outlet 33.

Figure 6:
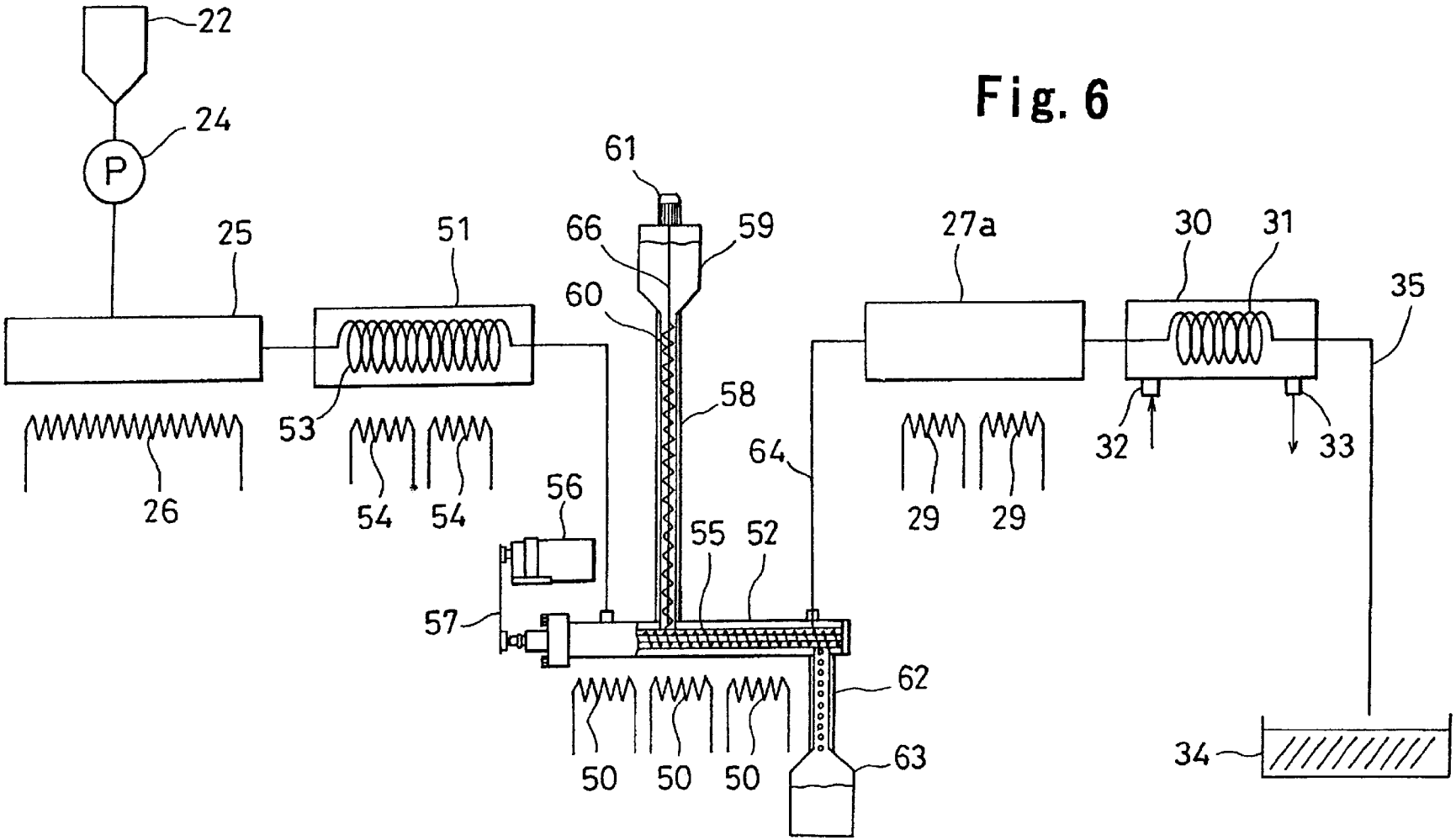
FIG. 6 is a schematic diagram of a system, according to a third embodiment of the present invention.

A decomposition system of a third embodiment according to the present invention will now be explained referring to FIG. 6, and the system is arranged for decomposing substances such as rubber, wood, paper, etc., which remain residual substances in the reactor after the decomposition process. It should be noted that the components to which the same reference numbers are given indicate the corresponding parts as that of shown in FIG. 1 respectively. According to the third embodiment, it provides a residue transporting mechanism, and a decomposed substances preserving tank since it manages residues of inorganic compounds such as that of carbon, which remain in the reactor when the substances such as rubber, wood, and paper are decomposed.

According to the third embodiment, a transport type of reactor 52 is provided between the superheated vapor generator 51 and a second reactor 27*a*. Inside of the reactor 52, a feeder 55 is provided to which the driving power of a motor 56 is transmitted via a belt 57. The reactor 52 has a plurality of heaters 50 wound around its periphery.

Further the reactor 52 is supplied with piping 58 connected to the midpoint thereof, which transports components to be decomposed, and which provides a hopper 59 at the other end thereof, and inside of the hopper a feeder 60 and a driving shaft 66 are positioned. 61 indicates a motor for driving the feeder 60 via the driving shaft 66.

The bottom of almost the other end of reactor 52, is equipped with a piping 62 for discharging decomposition residue substances which completes the decomposition process, and a tank 63 for storing residue substances. The top of reactor 52 is also equipped with a piping 64 which is connected to a secondary reactor 27*a*. The arrangements of the secondary reactor 27*a* and the cooler 30 are similar with that of the reactor 27 and the cooler 30 of the first embodiment described above respectively.

According with the third embodiment, the solvent is sent from the solvent tank 22 via the pump 24 to the vapor generator 25 by which it is converted to approximately higher than 100° C. of a vapor, which is then sent to the superheated vapor generator 51 by a pressure gradient produced by the vapor pressure. The steam is further heated up to approximately 500° C. as a superheated vapor, which is further transferred to the transport type of reactor 52 by a pressure gradient produced by the vapor pressure similarly as described above. The inside of reactor 52 is heated by the heaters 50 similarly as described above with the first embodiment, such that the superheated steam can be maintained at its temperature, while the motor starts to drive the feeder 60 after the substances to be decomposed such as rubbers have been thrown into the hopper 59, thereby the substances are supplied into the reactor 52 in the atmosphere of the superheated solvent steam. Further, the driving power from the motor 56 is transmitted via the belt 57 to the feeder 55 positioned inside of the reactor 52 so that both of the substances to be decomposed and the superheated solvent steam are stirred together and transferred within the reactor 52 while the decomposition process is proceeding.

The substances are thus processed to decompose during transport. Mostly, the substances are converted to oily substances so that vaporized components of these substances are transferred with the superheated solvent vapor to the secondary reactor 27*a,* which is similar to the reactor 27 of the first embodiment, via the piping 64, and while passing through the reactor 27*a* the internal temperature which is maintained at the predetermined temperature for proceeding further the decomposition process. The resulting substances are transferred to the cooling unit 30 for liquefying. The solid components remain as residues in reactor 52 and then fall through the discharging piping 62 into the tank 63 wherein the substances are stored. In cases where the substances to be decomposed are wood, cellulose component is then cracked into glucose component, which is stored in the tank 63.

More specifically in cases where the substances to be decomposed are wood, pyrolygneous acid is retrieved from the substances at 100° C. in the reactor 52, while the cellulose component is cracked down into the glucose component at 200° C. In the case of rubber, sulfur is separated from the substances at approximately 300° C., and is discharged as acidic liquid waste solution together with steam flow. Stopping the decomposition at this stage, the residue can be reused as rubber. If the reaction temperature is increased to 350–400° C., then the substances are converted into low molecular weight compounds of oil which is discharged with the steam flow so that the residue includes only carbon substances. By suitably selecting the temperature and the residence time within the reactor 52, the degree of the decomposition process can be selected in accordance with the object, such as to complete oiling or to obtain other recycling resources.

Figure 7:
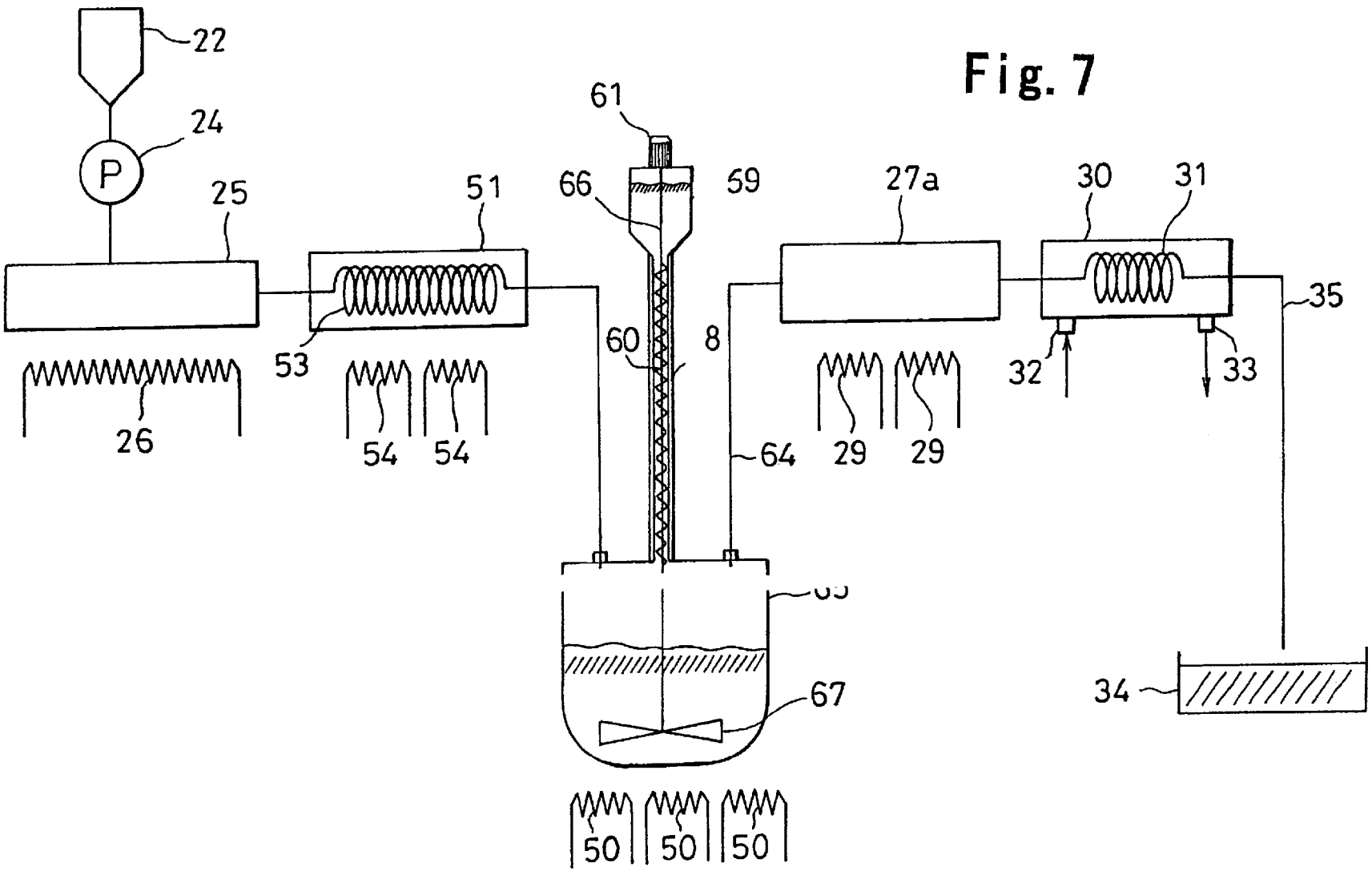
FIG. 7 is a schematic diagram of a system, according to a fourth embodiment of the present invention.

Now a system of a fourth embodiment according to the present invention will be explained referring to FIG. 7, wherein the substances to be decomposed are completely converted to oily substances, without remaining solid components by the heating process. Such substances to be decomposed may be plastic products made of polyethylene. Note that the components to which the similar reference numbers are given in FIG. 6 indicate the corresponding parts as that of the third embodiment shown in FIG. 1 respectively.

According to the fourth embodiment, a sealed type of a reactor tank 65 is provided which is positioned between the superheated vapor generator 51 and the reactor 27*a* of the third embodiment, instead of the transfer type of the reactor 52, and to which a supply piping 65 is connected. To the supply piping 58 a hopper 59 is attached, inside of which a feeder 60 and a drive shaft 66 are positioned. The driving shaft 66 extends to the vicinity of the bottom of the reactor 65, at the end of which stir wing 67 is attached. 61 indicates a motor which drives the feeder 67 and the stir wing 67 via driving shaft 66.

According to the fourth embodiment, the solvent is sent from the solvent tank 22 via the pump 24 to the vapor generator 25 by which it is converted to approximately more than 100° C. of a vapor, which is then sent to the superheated vapor generator 51 by a pressure gradient produced by the vapor pressure as in the third embodiment described above. The vapor is further heated up to approximately 500° C. of superheated steam, which is further transferred to a reactor 65 by a pressure gradient produced by the vapor pressure similarly as described above. Inside of the reactor 62 is heat produced by the heaters 50 similarly as the first embodiment described above, such that the superheated vapor can maintain its temperature, while the motor 61 starts to drive the feeder 60 after the substances of plastic products such as polyethylene to be decomposed have been thrown into the hopper 59, thereby the substances are supplied into the reactor 65. Further, by the rotational drive of the driving shaft 66, both of the substances to be decomposed and the superheated solvent steam are stirred together while the decomposition process is proceeding.

The substances are thus processed and decompose during stirring. The substances of plastic products such as polyethylene, are converted to oily substances such as paraffm or olefins, so that vaporized components of these substances are transferred with the superheated solvent vapor to the secondary reactor 27*a* via the piping 64, and through the reactor 27*a*. The substances are further decomposed to oils having a lower carbon number and less viscosity, and are transferred to the next stage of the cooling unit 30. The volume of the reactor 27*a* can be suitably selected, so that the decomposition reaction time can be determined to control the degree of the oiliness. That is, to decompose down to a lower carbon number of substances, such as kerosene, gasoline etc.

More specifically, if the substances to be decomposed are polyethylene, the decomposition process begins at more than 400° C. in the reactor 65, chains of long chained high molecule materials are cut by increasing the heating temperature, so that lighter substances evaporate, and for heavier substances (which are hard to evaporate), chains are cut small in decomposition during evaporation transfer, but at 500° C. substances are completely decomposed to oily substances. Taking the substances out of the reactor immediately after this [head] decomposition process, the substances to be decomposed will be converted to paraffm of grease-like substances, or oils of olefms in the grease-like form, but further increasing and suitable residence time in the reactor 27 the substances will be converted to provide liquid oil having lower molecule numbers.

According to the fourth embodiment, performing further decomposition in the reactor 27*a,* will change oils with higher carbon numbers into less viscosity oils, and if the decomposition process is determined to be insufficient, then the process can be further continued. More specifically, in case of decomposing substances such as polyethylene, soon after the decomposition process starts, it will produce vapor from the decomposition substances, which is mixed with the superheated solvent vapor to generate a stream of the mixed vapor, which is transferred to the next stage. This steam contains oils of high carbon numbers, and it can be further decomposed in order to convert it into oils having less carbon number. It should be noted that in the third and fourth embodiments, the secondary reactor 27*a* may be eliminated, and the reaction time either in the transfer type of the reactor 52 or in the tank 65 may be increased.

Figure 8:
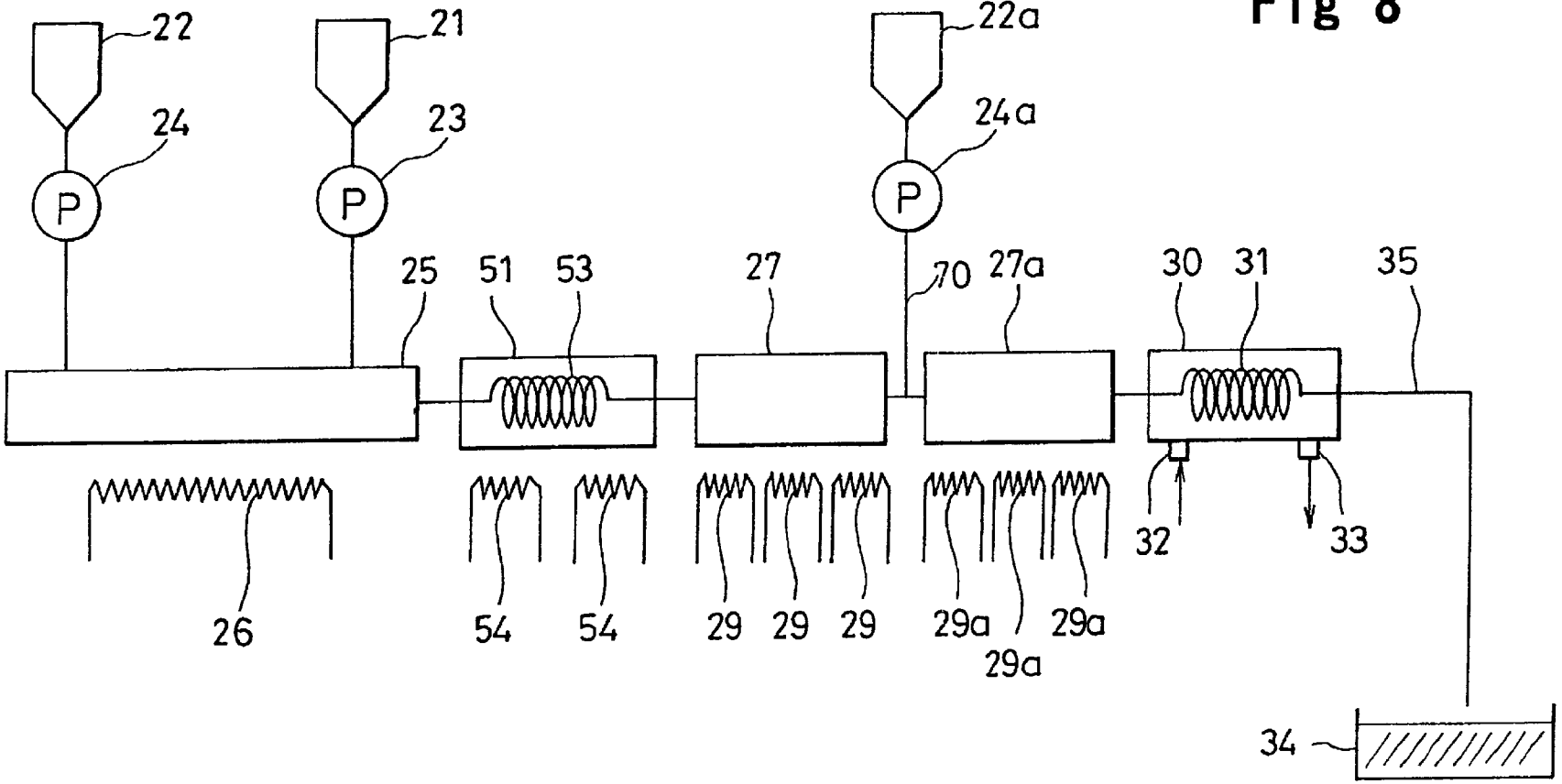
FIG. 8 is a schematic diagram of a system, according to a fifth embodiment of the present invention.

Now, a system of the fifth embodiment according to the present invention will be explained referring to FIG. 8, wherein solvent tank 22*a,* is filled with a solvent suitable for decomposed substances as generated, and pump 24*a* is provided between the reactor 27 and the secondary reactor 27*a,* that is, one end of piping 70 is connected to the pump 24*a* and the other end is connected to the piping between 27 and the reactor 27*a*. Note: the components which have similar reference numbers, given in FIG. 1 indicate the corresponding parts as that of the first embodiment shown in FIG. 1, respectively.

According to the fifth embodiment, the primary decomposed substances from the reactor 27 are transferred to the secondary reactor 27*a,* similarly as in the first embodiment described above, and a new solvent, which is suitably selected for the primary decomposed substances, is also taken from the solvent tank 22*a* to the reactor 27*a* via the pump 24*a,* and the substances in the reactor 27*a* are maintained in a superheated steam state together with the solvent. This secondary decomposition process of the primary decomposed substances is thus performed and the resulting substances are transferred from the reactor 27*a* to the next stage of the cooling unit 30.

According to the fifth embodiment, the decomposition reaction to the substances can be increased since the solvent, which is suitably selected for the primary decomposed substances from the reactor 27 to decompose, is newly supplied to the reactor 27*a*.

Figure 9:
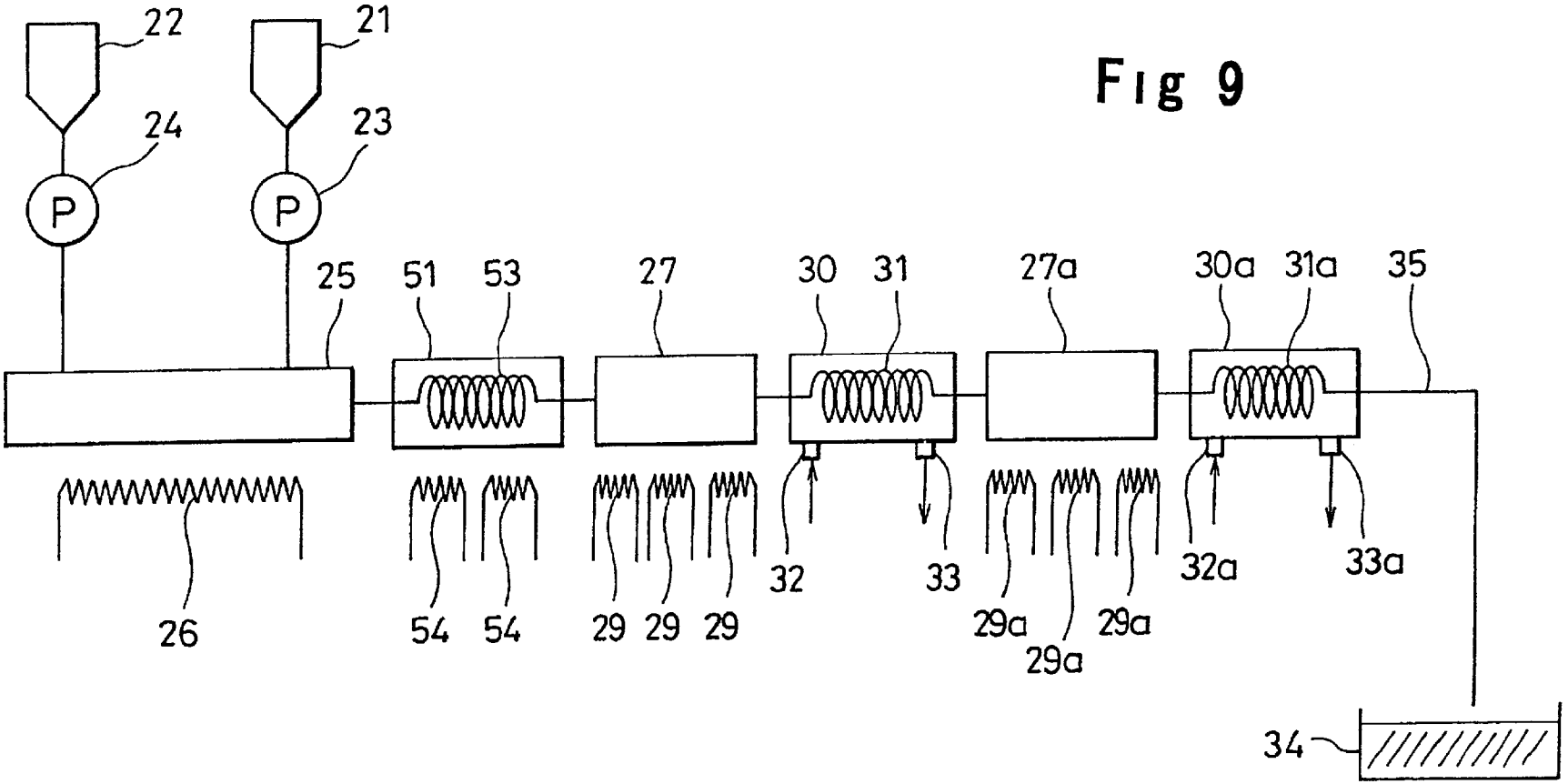
FIG. 9 is a schematic diagram of a system, according to a sixth embodiment of the present invention.

Now the sixth embodiment of the present invention, referring to FIG. 9, wherein a second reactor 27*a* and a second cooling unit 30*a* are provided following the cooling unit 30. Reactor 32*a* is an inlet of cooling water, and 33*a* is an outlet of coolong water. It should be noted that the components which have similar reference numbers of FIG. 1, indicate the corresponding parts as that of the first embodiment respectively.

According to the sixth embodiment, the substances which are produced by decomposing in the reactor 27 and then cooled in the cooling unit 30, become limited in their substances and transferred to the second reactor 27*a,* which are maintained at the predetermined temperature using the heater 29*a,* and evaporated, but the evaporating temperature is different, so that a similar effect can be attained. That is, the decomposition process is continued but is restricted to producing a by-product, and transferred to the cooling unit where the decomposed substances are cooled.

The decomposing reaction effect can be increased for the substances to be decomposed, since the cooling unit 30 exist between the first reactor 27 and the second reactor device.

In cases where the solvent is water, the reaction proceeds mainly by hydrolysis, and in cases where the solvent is alcohol, then alcohol itself is thermally decomposed:

$$CH_3OH \rightarrow H_2O + H_2 + C$$

Therefore, decomposition by reduction of H2, and decomposition by hydrolysis of H2O exist concurrently, which makes the reaction effective in the case where the decomposition with hydrolysis only is not satisfactory, or the reaction rate is very low. It should also be noted that some organic compounds may be produced as by-products, unless sufficient decomposition time is not taken.

In cases where the solvent is hydrogen peroxide, the decomposition is easily performed by applying heat:

$$2H_2O_2 \rightarrow 2H_2O + O_2$$

That is, hydrolysis and oxidation exist and coexist. Oxidation in the water-vapor is called wet burning when organic compounds react with carbon to produce $CO_2$, which is exoergic reaction so that the decomposition reaction proceeds with chain reaction.

Figure 10:
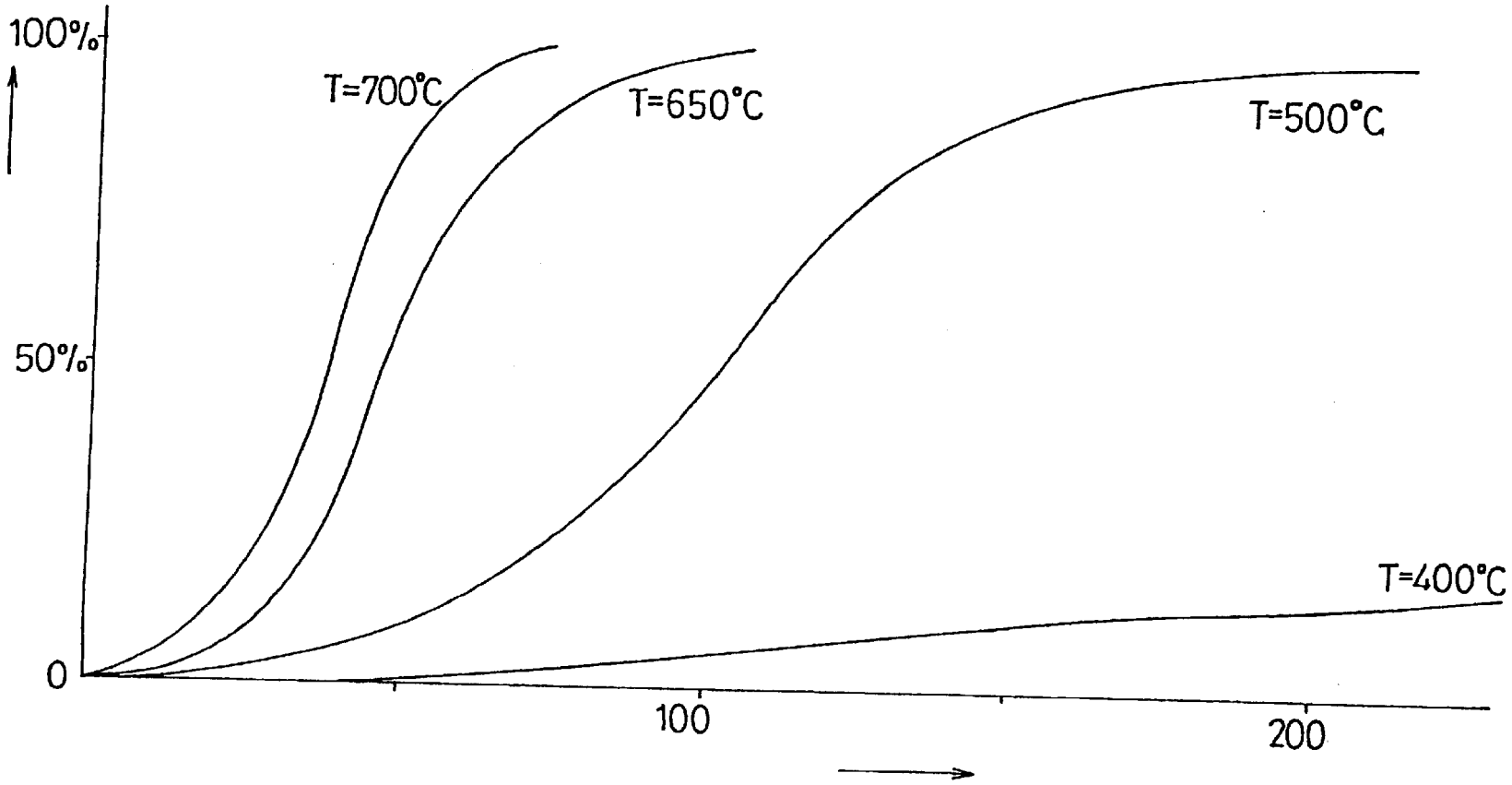
FIG. 10 is a graph showing the decomposition ratio of chlorofluorocarbon CFC-12 to time with changing the superheated vapor temperature when water is used as catalyst.

FIG. 10 shows a graph indicating the decomposition rate of chlorofluorocarbon CFC-12 versus time at superheated steam temperatures of 700° C., 650° C., 500° C. and 400° C. with water used as a solvent. The graph shows that the shortest time to reach a 100% decomposition rate occurs at 700° C., but 500° C. may also be accepted as practical.

Reaction formulas will now be described. These formulas are assumed from products found in decomposition liquid, produced as a result of a decomposition reaction, performed according to the present invention, which includes such substances as chlorofluorocarbon, trichloroethane other than chlorofluorocarbon, benzene which are organic compounds having a benzene nucleus, and monochlorobenzene. Here, water, hydrogen peroxide,and methanol have been used as solvents, and reaction temperature and reaction time have been 650° C. and 120 seconds, respectively.

In the first case, in case of chlorofluorocarbon CFC-12, the following reactions proceed:

[solvent=water]

$$CCl_2F_2 + 2H_2O \rightarrow CO_2 + 2HCl + 2HF$$

[solvent=hydrogen peroxide ]

$$CCl_2F_2 + 2H_2O_2 \rightarrow CO_2 + 2HCl + 2HF + O_2$$

[solvent=methanol]

$$CCl_2F_2 + 4CH_3 \rightarrow CH_4 + 2HCl + 2HF + 4C + 4H_2$$

or $$2CH_3OH + CCl_2F_2 \rightarrow 3C + 2HF + 2HCl + 2H_2O$$

[solvent=hydrogen peroxide]

In the case of chlorofluorocarbon CFC-14, the following reactions proceed:

[solvent=water]

$$CF_4 + 2H_2O \rightarrow CO_2 + 4HF + O_2$$

[solvent=hydrogen peroxide]

$$CF4 + 2H_2O \rightarrow CO_2 + 4HF + O_2$$

[solvent=methanol]

$$CF_4 + 4CH_3OH \rightarrow CH_4 + 4HF + 4C + 4H_2O$$

In the following description, decomposition of chlorofluorocarbon with methanol and hydrogen peroxide are excluded, since hydrolysis by water can be applicable:

In cases of chlorofluorocarbon CFC-11:

[solvent=water]

$$CCl_3F + 2H_2O \rightarrow CO_2 + 3HCl + HF$$

Also in cases of chlorofluorocarbon CFC-113:

[solvent=water]

Reactions of the following formula proceed. Other cases such as chlorofluorocarbon CFC-22, CFC-13 are recognized to be decomposable with 100% similarly by applying water as solvent.

$$C_2Cl_3F_3 + 3H_2O \rightarrow CO + CO_2 + 3HCl + 3HF$$

Descriptions are made for cases where the present invention is applied (except for chlorofluorocarbon). In the first case of trichloroethene:

[solvent=water]

Reaction of:

$$CH_3CCl_3 + H_2O \rightarrow 3HCl + CO + C + H_2$$

and reaction of:

$$CH_3CCl_3 + 2H_2O \rightarrow 3HCl + CO_2 + C + 2H_2$$

are simultaneously performed.

[solvent=hydrogen peroxide]

Reaction of:

$$CH_3CCl_3 + H_2O_2 \rightarrow 3HCl + 2CO + H_2$$

and reaction of:

$$CH_3CCl_3 + 2H_2O \rightarrow 3HCl + CO_2 + C + H_2$$

are simultaneously performed.

[solvent=methanol]

Reaction of:

$$CH_3CCl_3+4CH_3OH \rightarrow 2CH_4+3CHl+4C+4H_2$$

is performed.

In cases where the substance to be decomposed is benzene ($C_6H_6$), the following reaction is performed:

[solvent=water]

Reaction of: $C_6H_6+H_2O \rightarrow C_6H_5OH+H_2$ is performed.

[solvent=hydrogen peroxide]

Reaction of:

$$C_6H_6+6H_2O_2 \rightarrow 6CO+3H_2+6H_2O$$

and reaction:

$C_6H_6+6H_2O_2 \rightarrow 6CO_2+9H_2$ are simultaneously performed.

[solvent=methanol]

Reaction of:

$$C_6H_6+12CH_3OH \rightarrow 6CH_4+12H_2O+12C+3H_2$$

is performed.

In cases where the substance to be decomposed is monochlorobenzene ($C_6H_5Cl$):

[solvent=water]

Reaction of:

$$C_6H_5Cl+H_2O \rightarrow C_6H_5OH+HCl$$

is performed:

[solvent=hydrogen peroxide]

Reaction of:

$$C_6H_5Cl+6H_2O_2 \rightarrow 6CO+HCl+2H_2+6H_2O$$

and reaction of:

$C_6H_5Cl+6H_2O_2 \rightarrow HCl+6CO_2+8H_2$ are simultaneously performed.

[solvent=methanol]

Reaction of:

$C_6H_5Cl+12CH_3OH \rightarrow 6CH_4+12H_2O+12C+HCl+2H_2$ is performed.

Figure 11:
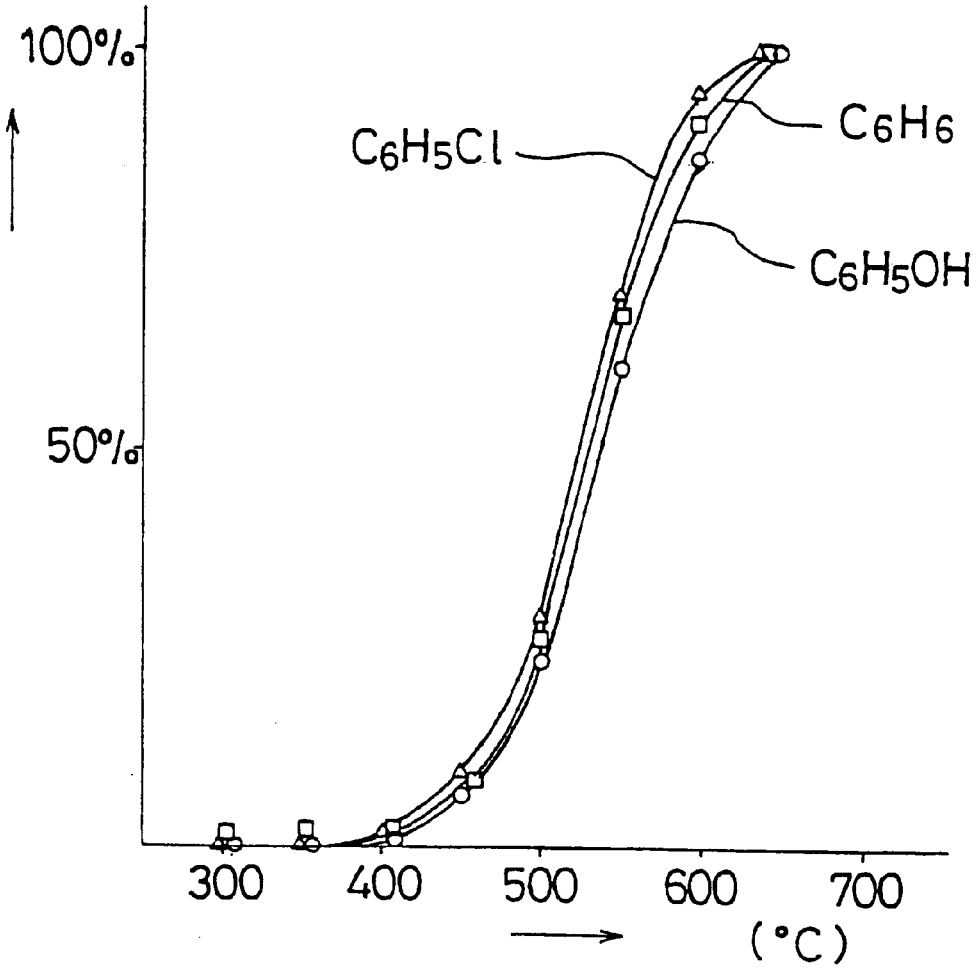
FIG. 11 is a graph showing decomposition velocity to temperature in decomposing monochlorobenzene, and phenol when peroxide is used as a catalyst.

FIG. 11 shows a graph indicating the relation of time to the decomposition rate of monochlorobenzene ($C_6H_5Cl$), benzene ($C_6H_6$) and phenol ($C_6H_5OH$) with hydrogen peroxide used as a solvent, In these cases, the decomposition rate reaches 100% at a temperature of approximately 650° C.

Figure 12:
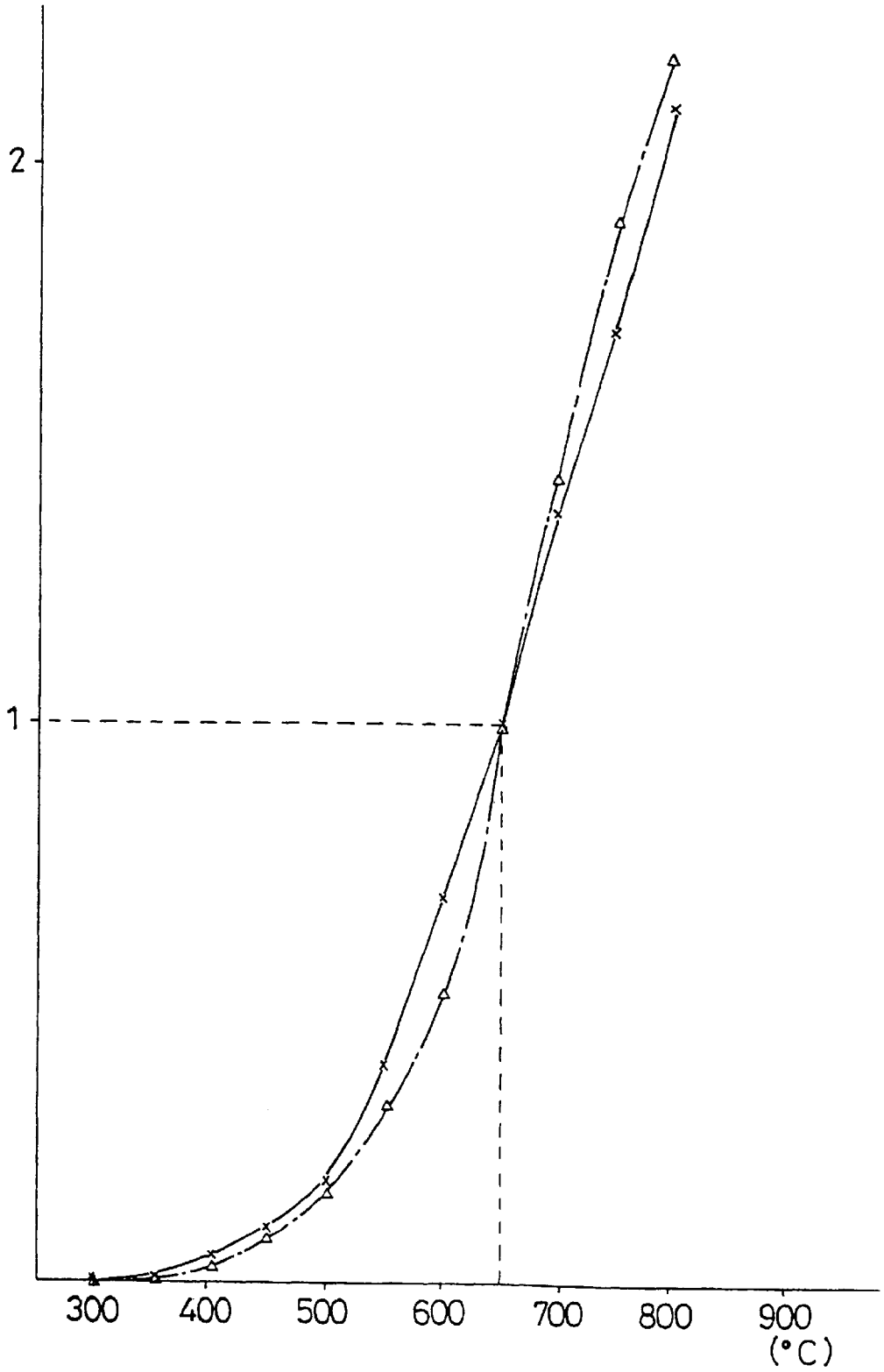
FIG. 12 is a graph showing the decomposition rate at a other temperature range, when the decomposition rate of a superheated vapor temperature of 650° C. of chlorofluorocarbon CFC-12 is assumed to be 1.
Figure 13:
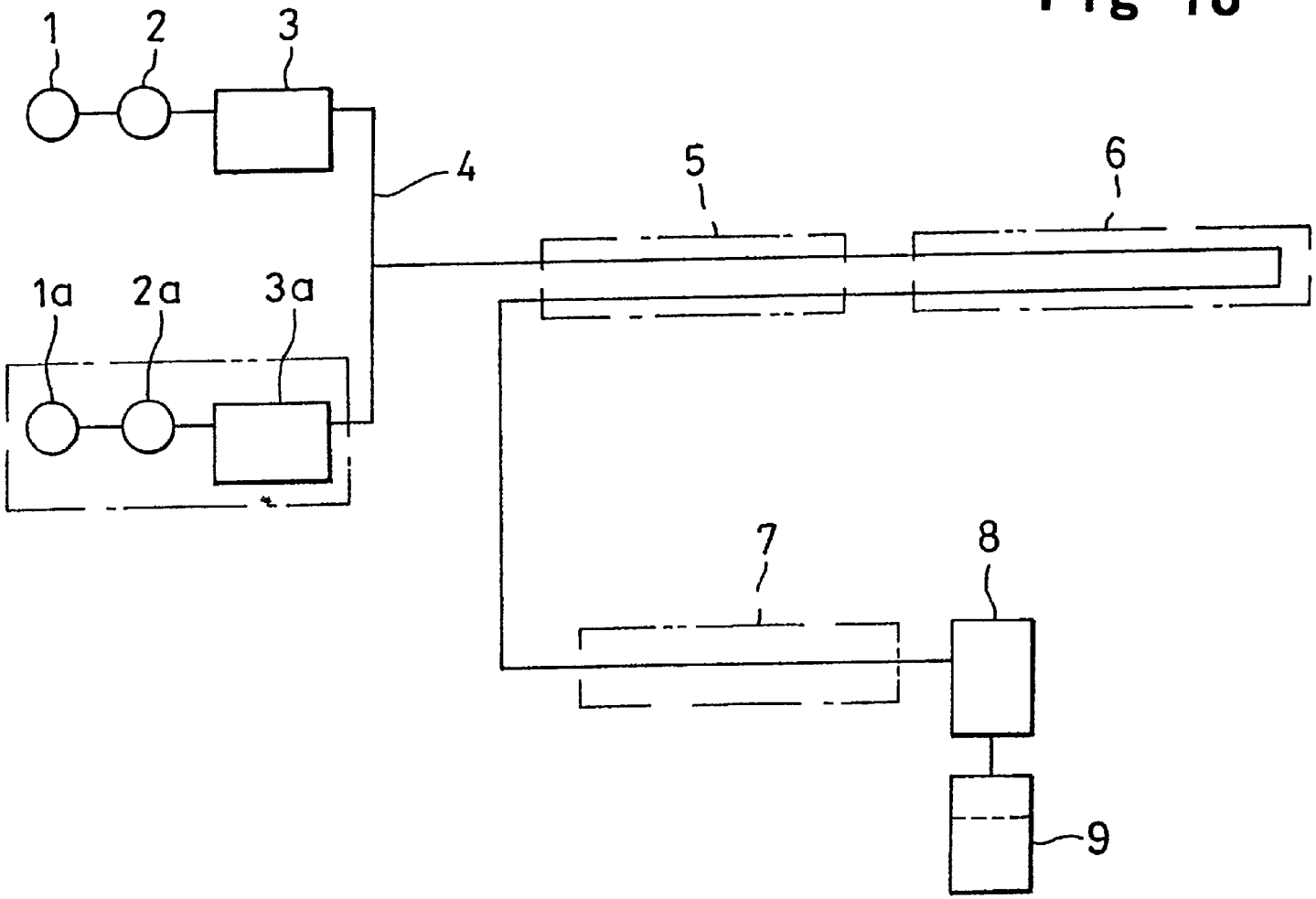
FIG. 13 is a flow diagram of chlorofluorocarbon decomposing process system of prior art.
Figure 14:
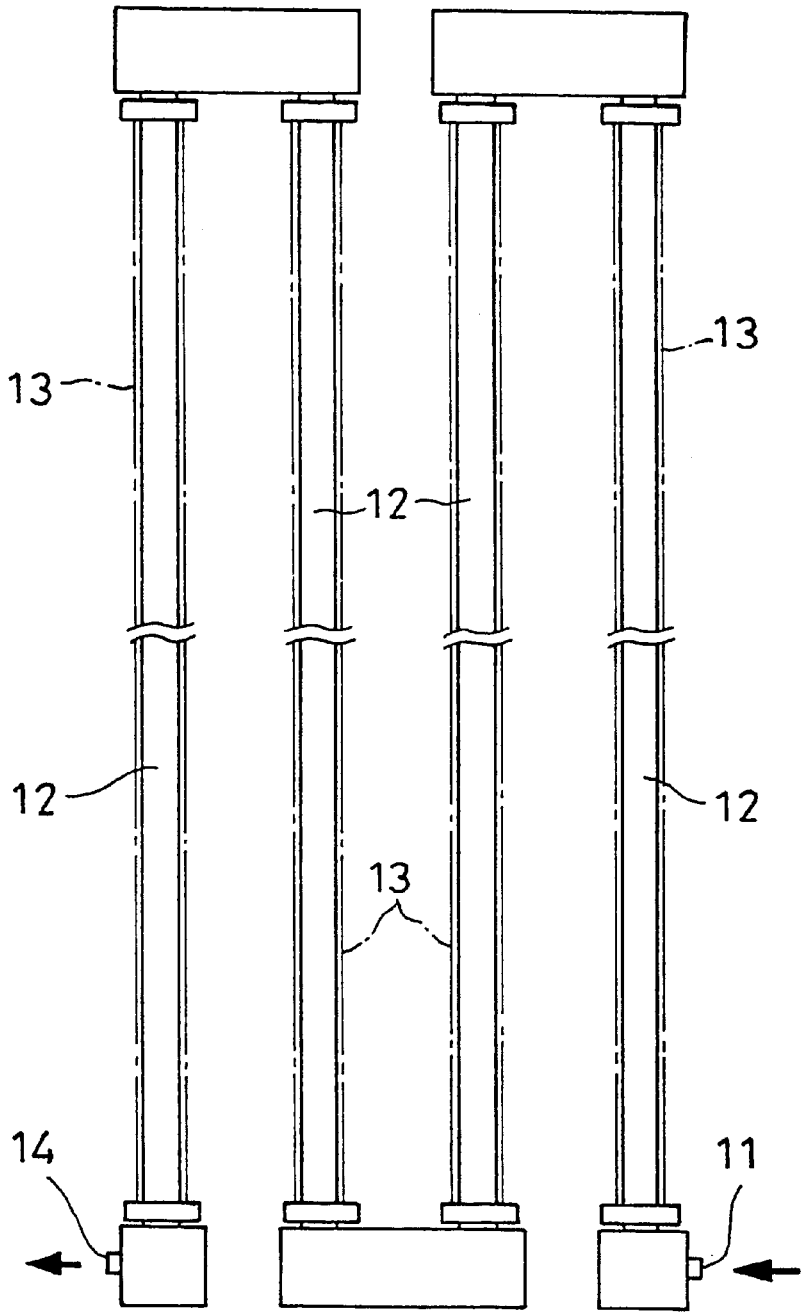
FIG. 14 is a schematic diagram of hydrothermal reactor shown in the system flow diagram of FIG. 13.

FIG. 12 shows a graph indicating the decomposition rate ratio of chlorofluorocarbon CFC-12 to some range of temperature when the decomposition rate of 650° C. is used as reference of 1. From the experimental results performed as described above, it is understood that the present invention can be used for decomposing any organic compound including a benzene ring, and can significantly enhance such a decomposition process that has been understood as difficult even for the decomposition experiment using supercritical water.

According to the present invention as described above in detail, persistent substances such as, chlorofluorocarbon gas, is converted to a vapor together with a suitable solvent, which is further heated up to provide the superheated vapor with only its temperature increased, or which is supplied into a superheated solvent vapor atmosphere, in which the vapor is allowed to pass through the reactor taking a predetermined reaction time for decomposing the substances. The superheated vapor, which has completed the decomposition process, is then cooled and converted into a liquefied substance which is ready to discharge. Specifically, this system has a main process of heating substances to be decomposed under atmospheric pressure so that they do not require any high pressure pump, which eliminates the possibility of damage in the discharge valve or the piping. Since every reaction occurs within the reactor which forms a closed system, no secondary pollution is expected.

When decomposing persistent substances including solid components, the decomposition process is performed within the reactor during the time when substances are being transferred by a transfer device, so that the remaining solid components after the process is completed are inherently ejected from the reactor. The decomposition process can also be enforced by stirring the substances to be decomposed within the reactor. Further, the reaction time and temperature can suitably be selected, so that the decomposition degree is controlled in order to meet with the product to be produced. That is, polyethylene; rubber; and cellulose of wood included in waste can be processed with variable conditions according to the degree of oiliness; reclaimed rubber; and useful glucose resources, respectively.

The catalyst method known in the prior art has problems in the catalysis degradation, due to the oxidation, but according to the present invention, these problems are solved, since this invention does not use the catalysis, and the present invention can also be applicable not only to chlorofluorocarbon, but also to other industrial waste, and organic substances containing a benzene nucleus.

According to the present invention, the complete decomposition ratio is provided within quite a short period of processing time such as 30–120 seconds, and by selecting a suitable operation temperature, it can provide the activation energy required to start up the decomposition process, and also by selecting a suitable solvent stream in connection with the substances to be decomposed, it can provide a stable decomposition rate and decomposition ratio, and can substantially decompose all kinds of organic compounds.

According to the present invention, any material can be suitably selected, since the process is performed under low pressure. Therefore, any material can be selected, unless it cannot withstand a predetermined high temperature, and any specific design is not required for mechanical strength, tensile strength and/or thermal stress, and can easily be prepared for breakage of several equipment, and can easily be automated for the system itself. Furthermore, it can readily stop the transfer of liquid, if any failure occurs in its piping etc, which in turn, can readily stop the generation of superheated vapor to secure system safety, since reactions are performed in the superheated vapor atmosphere.

What is claimed is:

1. A method for decomposition of chlorofluorocarbon to be decomposed and then disposed of; comprising the steps of:

heating a mixture of liquid chlorofluorocarbon substances to be decomposed and then disposed of and a liquid member selected from the group consisting of water, methanol, hydrogen peroxide, and mixtures thereof to a temperature of from about 500° C. to about 700° C. in order to produce a superheated vapor, and maintaining the superheated vapor in a reactor for a sufficient reacting time in order to achieve decomposition of the chlorofluorocarbon in the mixture before passing through said reactor to a discharge outlet open to the environment.

2. The method of claim 1, including the step of cooling the superheated vapor to a liquid after passing through the reactor.

3. The method of claim 2, including the step of discharging the liquefied superheated vapor.

* * * * *